US005080235A

United States Patent [19]

Nichols et al.

[11] Patent Number: 5,080,235

[45] Date of Patent: Jan. 14, 1992

[54] SMALL PARTICLE SEPARATOR

[75] Inventors: Carl W. Nichols, Sylacauga, Ala.; Michael J. Lorang; Michael O. Wold, both of Bozeman, Mont.; Jerry W. Rayfield, Sylacauga, Ala.; Marvin F. Hansen, Alder; Richard D. Johnson, McAllister, both of Mont.

[73] Assignee: Cyprus Mines Corporation, Englewood, Colo.

[21] Appl. No.: 588,202

[22] Filed: Sep. 27, 1990

[51] Int. Cl.[5] ..... B07C 9/00

[52] U.S. Cl. ..... 209/700; 209/638

[58] Field of Search ..... 209/638, 641, 642, 700, 209/707

[56] References Cited

U.S. PATENT DOCUMENTS

| | | | |
|---|---|---|---|
| 218,380 | 8/1879 | Granniss et al. | 209/638 |
| 239,994 | 4/1981 | Truax . | |
| 645,442 | 3/1900 | Tromanhauser . | |
| 719,343 | 1/1903 | Langerfeld | 209/638 X |
| 753,591 | 3/1904 | Langerfeld | 209/638 |
| 753,592 | 3/1904 | Langerfeld . | |
| 1,030,042 | 6/1912 | Wilmot et al. . | |
| 1,058,259 | 4/1913 | Pratt . | |
| 1,132,011 | 3/1915 | Horst . | |
| 1,136,423 | 4/1915 | Horst . | |
| 1,190,926 | 7/1916 | Lotozky . | |
| 1,353,856 | 9/1920 | Schlunke | 209/638 |
| 1,744,967 | 1/1930 | Johnson . | |
| 2,123,301 | 7/1938 | Grave . | |
| 2,607,482 | 8/1952 | Weisz . | |
| 2,612,269 | 9/1952 | Vogel | 209/422 |
| 2,778,498 | 1/1957 | Vincent . | |
| 3,004,665 | 10/1961 | Leslie . | |
| 3,127,016 | 3/1964 | Baigent . | |
| 3,485,360 | 12/1969 | Deinken et al. . | |
| 3,508,645 | 4/1970 | Conrad | 209/2 |
| 3,591,000 | 7/1971 | Humphreys | 209/210 |
| 3,672,500 | 6/1972 | Hayes . | |
| 3,805,953 | 4/1974 | Jones et al. | 209/639 |
| 3,876,074 | 4/1975 | Douglas et al. . | |
| 3,910,835 | 10/1975 | Stafford . | |
| 3,945,915 | 3/1976 | Wilson | 209/638 X |
| 4,009,783 | 3/1977 | Park . | |
| 4,059,189 | 11/1977 | John . | |
| 4,486,300 | 12/1984 | Prieb | 209/135 |
| 4,894,148 | 1/1990 | Frei | 209/930 X |

FOREIGN PATENT DOCUMENTS

| | | | |
|---|---|---|---|
| 73038 | 10/1891 | Fed. Rep. of Germany | 209/638 |
| 473939 | 2/1915 | France . | |
| 899105 | 5/1945 | France . | |
| 997675 | 1/1952 | France . | |
| 305843 | 6/1971 | U.S.S.R. | 209/642 |
| 496053 | 4/1976 | U.S.S.R. . | |
| 1240476 | 6/1982 | U.S.S.R. . | |
| 1165497 | 7/1985 | U.S.S.R. . | |
| 235738 | 6/1925 | United Kingdom . | |
| 365384 | 1/1932 | United Kingdom . | |
| 581610 | 10/1946 | United Kingdom . | |
| 1224614 | 3/1971 | United Kingdom . | |
| 2046632 | 11/1980 | United Kingdom . | |
| 8902320 | 3/1989 | World Int. Prop. O. | 209/700 |

*Primary Examiner*—Donald T. Hajec

*Attorney, Agent, or Firm*—Banner, Birch, McKie & Beckett

[57] ABSTRACT

Apparatus for the separation of a mixture of discrete particulate solid materials of disparate composition and a system utilizing such apparatus is described in which the material to be processed is caused to slide under the influence of gravity along a straight inclined surface to achieve a substantially uniform velocity and thereafter along an arcuately formed surface where, due to the existence of different coefficients of sliding friction between the mixture fractions, disparate velocities are achieved by the respective particles whereby particles of the respective fractions are separately collected on a velocity basis. The described apparatus utilizes a slide surface of different material and/or a water spray to produce the disparate velocities between the particles of the respective mixture fractions. Deflector plates of various forms may be employed to prevent contamination of the clean product fraction due to bouncing of materials of the waste product fraction from the slide surface.

29 Claims, 4 Drawing Sheets

14
16
34
32
38
42
30
12'
18
40
68
44
70
72
50
48
20
60
62

SMALL PARTICLE SEPARATOR

FIELD OF THE INVENTION

This invention relates to apparatus for the beneficiation of a mixture of discrete particulate solid materials. More particularly, the invention relates to the sorting of two or more materials of relatively small particulate size in which the materials are separated on the basis of their respective sliding coefficients of friction.

BACKGROUND OF THE INVENTION

Mined ores and other minerals usually contain impurities. Consequently, the desired ore or mineral product must be separated from the rest of the material, as mined. Talc, for example, exists in its natural state in rock formations in which it is typically associated, or combined with, dolomite and possibly also other minerals such as chlorite, quartz, pyrite, magnesite, calcite, feldspar, mica, etc., and mixtures thereof. In the production of talc, until recently, separation of the pure talc fraction from that of the impurities, hereinafter referred to collectively as "dolomite", had been effected by hand sorting, an arduous function that adds measurably to the time and cost of producing a product of commercial grade.

It has been determined that talc and dolomite exhibit differences of coefficients of sliding friction, and thereby, can be effectively separated on this basis. Apparatus disclosed in U.S. patent application Ser. No. filed 097,877, filed Sept. 17, 1987, and assigned to the assignee hereof describes a separating apparatus by which the materials, as mined, are induced by centrifugal forces to undergo sliding movement across a rotating surface whereby the talc and dolomite fractions are caused to move at different velocities such that they can be separately collected. Although the aforementioned apparatus is effective in separating talc from dolomite when the size of the particles to be separated is above about two inches in nominal diameter, its separating efficiency becomes significantly reduced on mixture particles whose nominal diameter is about two inches or less.

Separating apparatus utilizing inclined chutes having arcuately curved discharge portions are well known for classifying materials according to different properties. See, for example, U.S. Pat. Nos. 719,343, 753,591 and 753,592 to Langerfeld and U.S.S.R. Inventor's Certificate Nos. 496053 and 1165497. Such apparatus, as was heretofore known in the art, is, however, not dispositive of the problem addressed by the present invention. For example, the Langerfeld patents suggest utilization of an inclined surface of shallow extent whereby the particles of the mixture fractions are caused to achieve disparate speeds depending on their physical characteristics, such as specific gravity, form, size and/or the retardative nature of their surfaces in sliding along the inclined surface. The curved discharge portion at the end of each such incline serves simply to project the respective particles at different velocity-dependent trajectories wherein they can be collected in separate receiving bins.

U.S.S.R. Inventor's Certificate 496053, on the other hand, describes apparatus suitable for separating friable materials in which the angle of inclination of the inclined portion of the chute is made steep depending on the density and size of the particles being separated in order to permit the particles to achieve a velocity sufficient to impart a spinning motion therein wherein the particles will be fractured into smaller grains in contacting the chute surface prior to being discharged via a sifting surface as well as along disparate velocity induced trajectories to be, thereby, separately collected.

U.S.S.R. Inventor's Certificate 1165497 employs a steeply inclined chute having a section containing a concave-convex reversely curved discharge portion particularly adapted for separating relatively highly wetted particles wherein the smaller grain size fractions are caused by their being wetted to cling to the slide surface and thereby enable the collection of another mass-dependent material fraction.

It is to the amelioration of this problem, therefore, to which the present invention is directed.

SUMMARY OF THE INVENTION

Accordingly, the present invention provides a separator apparatus and a separating system utilizing such separator apparatus, particularly adapted to separate mixtures of diverse materials, especially pure talc from dolomite having relatively small particle size, by causing the particles to slide along the surface of a stationary inclined chute from whence they are ultimately projected at different trajectories for collection in separately spaced receptacles. The apparatus of the invention comprises a chute structure including an elongated, steeply inclined straight portion to which the mixture is fed by means of an appropriate feeder apparatus. The straight portion terminates in a tangentially disposed arcuately curved portion from which the particles of the respective material fractions are discharged at disparate velocities for collection in spaced receptacles. In particular, the invention provides apparatus for the separation of a mixture of discrete particulate materials of disparate composition comprising a downwardly inclined straight surface along which particles of the materials are adapted to slide, the surface being inclined to an extent sufficient to cause the particles to achieve a substantially uniform velocity while undergoing gravitationally-induced sliding movement along the surface; a concavely curved discharge portion tangentially disposed with respect to the terminal end of the inclined surface against which the particles are caused to slide at disparate velocities due to differences in sliding coefficient of friction between the particles and the surface of the discharge portion; means for feeding a particulate mixture to the upper end of the inclined surface for separation; and means forming a receptacle assembly located adjacent the discharge end of the discharge portion, the receptacle assembly having separate compartments disposed in mutually spaced relation for receiving the respective particles on a basis of their discharge velocities from the discharge portion.

According to an aspect of the invention, the separator apparatus, being particularly adapted for the separation of talc from dolomite, can be provided with a deflecting plate so arranged as to intercept any bouncing dolomite particles and thereby prevent their improper entry into the talc receptacle.

According to another aspect of the invention, a plurality of separators of the described type are serially arranged in stages for a greater efficiency of talc beneficiation.

For a better understanding of the invention, its operating advantages and the specific objectives obtained by its use, reference should be made to the accompanying drawings and description which relate to a preferred embodiment thereof.

DETAILED DESCRIPTION OF THE PREFERRED EMBODIMENT

Figure 1:
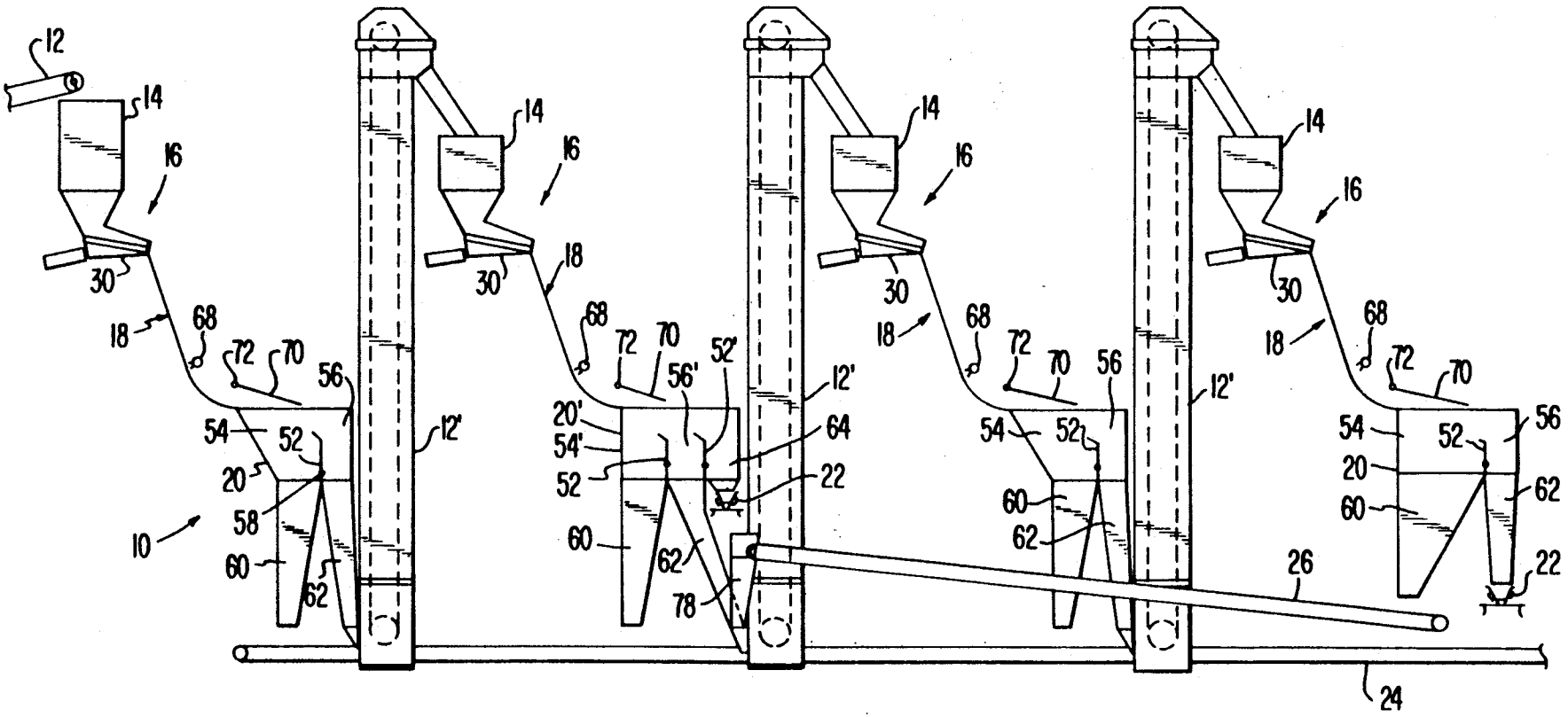
FIG. 1 is an essentially schematic representation of a small particle separation system constructed according to the present invention.

The particulate material separating system 10 shown in the drawings and described herein is particularly adapted for separating discrete particles of talc and the impurities in the mined ore thereof, hereinafter collectively referred to as "dolomite" and contains four operating stages, indicated generally as A through D in FIG. 1. It should be understood, however, that systems containing a greater or lesser number of operating stages are also contemplated by the invention. Each operating stage, a typical one of which is shown in somewhat greater detail in FIG. 2, comprises a feed conveyor 12, a feed bin 14, a separator supply device 16, a separator slide 18, a receptacle assembly 20, and various conveyors for moving dolomite tailings and talc product material. Such latter conveyors, as shown in FIG. 1, comprise endless belt conveyors including a product discharge conveyor 22 a tailings discharge conveyor 24 and a recycle conveyor 26, the latter being utilized for recycling dolomite tailings discharged from stage D of the system back to an earlier stage, as, for example, stage C, for reprocessing.

The described system 10 includes an endless belt feed conveyor 12 for supplying the first stage feed bin 14 with particulate material from a sizing or screening device (not shown), which material, in practice, is such as will pass through two inch screening. The feed conveyors utilized in each of the other stages, being required to move material through a considerable vertical extent, preferably are bucket conveyors, indicated as 12' in the drawing figures. The feed bins 14 each comprise a hopper having a tapered bottom penetrated by an opening 28 through which the particulate material to be processed passes onto a supply device, here shown as being a vibratory feeder 30. The feeder 30 includes a feed tray 32 with which the opening 28 from the bottom of bin 14 communicates and side walls 34 upstanding from the upper surface of the feed tray. The upper surface of the feed tray contains a particle distribution barrier 36, here shown as upstanding bar stock weldedly secured to the feed tray surface and being arranged in a chevron shape having its apex facing the feed bin opening 28. By means of this arrangement feed material to be processed is passed by gravity onto the surface of the feed tray and caused to migrate under the influence of the vibrating mechanism against the barrier 36. The bars forming the barrier are of insufficient height to prevent passage of the particles but operate, due to the shape of the barrier, to distribute the feed material laterally across substantially the full width of the tray surface as the material moves toward the lip 38 of the tray 32.

Each separator slide 18 comprises a smooth metal surface 40 forming a vertically inclined straight portion 42. The angle of inclination of the straight portion 42 is selected as that along which all of the mixture particles will slide until achieving a constant acceleration and, thereby, a uniform velocity. It has been determined that a slide 18 having a straight portion 42 with an effective length of about ten feet will produce the desired particle velocity characteristics when its vertical angle is between about zero degrees and about twenty degrees. Preferably, the vertical angle of the slide straight portion 42 is maintained at about eighteen degrees.

The end of the straight portion 42 of slide 18 terminates in a tangentially disposed, concavely curved discharge portion 44 that is preferably formed as a circular arc. The terminal end 46 of the discharge portion 42 is preferably disposed substantially tangent to the horizontal in order to insure, even during periods of adverse operating conditions, total discharge of all of the mixture materials from the end of the slide 18. It should be understood, however, that the discharge portion 44 can be provided with an arcuate extent that is slightly less than the 72 degree extent provided when the end 46 is tangent to the horizontal to as much as seventeen degrees beyond such tangential disposition.

The separator slide 18 is configured such that the mixture particles achieve substantially uniform velocities in sliding along the straight portion 42 whereupon, upon entering the discharge portion 44, the particles are induced by centrifugal forces to tightly slidably engage the arcuate surface thereof. As a result of this action the particles are caused to achieve, in the discharge portion 44, disparate velocities depending upon their respective relative coefficients of sliding friction with respect to the metal sliding surface. Thus, the particles forming the talc fraction of the mixture, in exhibiting a lower coefficient of sliding friction on the metal surface of the discharge portion 44, are caused to be discharged from the end 46 thereof at an appreciably greater velocity than the particles of the dolomite or tailings fraction which exhibit a greater coefficient of sliding friction than the talc fraction.

Means in the form of receptacle assemblies 20 are positioned adjacent the end 46 of the discharge portion 44 of each separator slide 18 for collecting the materials as separated. As shown, the receptacle assemblies 20 for each of the stages A, C and D in the disclosed system are similarly formed by metal plate members forming rectangularly disposed walls defining a box-like body 48 having an open upper end 50. A partition plate 52 is disposed within each body 48, which plate is substantially vertically upstanding and disposed transversely to the path of the discharge particles in order to divide the receptacle assembly into two longitudinally spaced compartments 54 and 56, the former being located closer to the discharge end of the slide 18 and adapted to receive the slower moving dolomite tailings. The compartment 56, on the other hand, is disposed longitudinally further away from the discharge end of the slide 18 and is adapted to receive the higher velocity particles that are predominantly talc.

As shown, the partition plate 52 can be mounted by means of pivot hinges 58 in order to render the plate angularly displaceable to adjust the relative product and tailings fractions collected in the respective compartments. Vertically elongated open ended discharge hoppers 60 and 62 connect with the compartments 54 and 56, respectively, in order to convey the separated particles to appropriate discharge conveyors, as hereinafter more fully described.

The receptacle assembly utilized at stage B of the described system is indicated generally as 20' and differs from the receptacle assemblies 20 at the other system stages in that it contains a third compartment 64 separated from the adjacent compartment 56' by a pivotally mounted partition plate 52'. In practice, it has been determined that in the second stage of the system, when the predominantly talc particles from the first stage are processed, a third fraction constituting essentially commercially pure talc can be separated in the compartment 64' and conducted to product storage via product belt conveyor 22.

In the disclosed apparatus and system, devices are employed to more closely regulate and control the separation function. For example, it is contemplated that the surface of the respective straight portions 52 of each separator slide 18 and the discharge portions 44 thereof be arranged to exhibit mutually different coefficients of sliding friction with respect to the particles. Consequently, in the described system, although the sliding surfaces 40 of the straight portions 52 and of the discharge portion 44, respectively, of the slides 18 in stages A and B are each formed of steel, the provision of a water spray device 68 designed to discharge water onto and wet the surface 40 of the discharge portion 44 of each slide 18 can effectively increase the differential coefficients of sliding friction between the respective particulate materials as they are caused to slide across the surface 40 of the discharge portion 44 since, while the wetted surface has little effect on the coefficient of sliding friction between the metal surface and the dolomite particles, it reduces significantly that between the surface and the talc particles. In practice water discharged at the rate of about 0.05 gallons/minute/foot of slide width is effective to achieve the desired results.

In stages C and D, similar water spray devices 68 are used to wet the discharge portions 44 of the respective slides 18; however, because of the relatively high incidence of talc in the waste fraction being processed, it is preferred that the sliding surfaces of the discharge portions 44 in these stages be formed of aluminum, or an aluminum alloy, while the sliding surfaces of the straight portions 52 therein remain steel.

Figure 2:
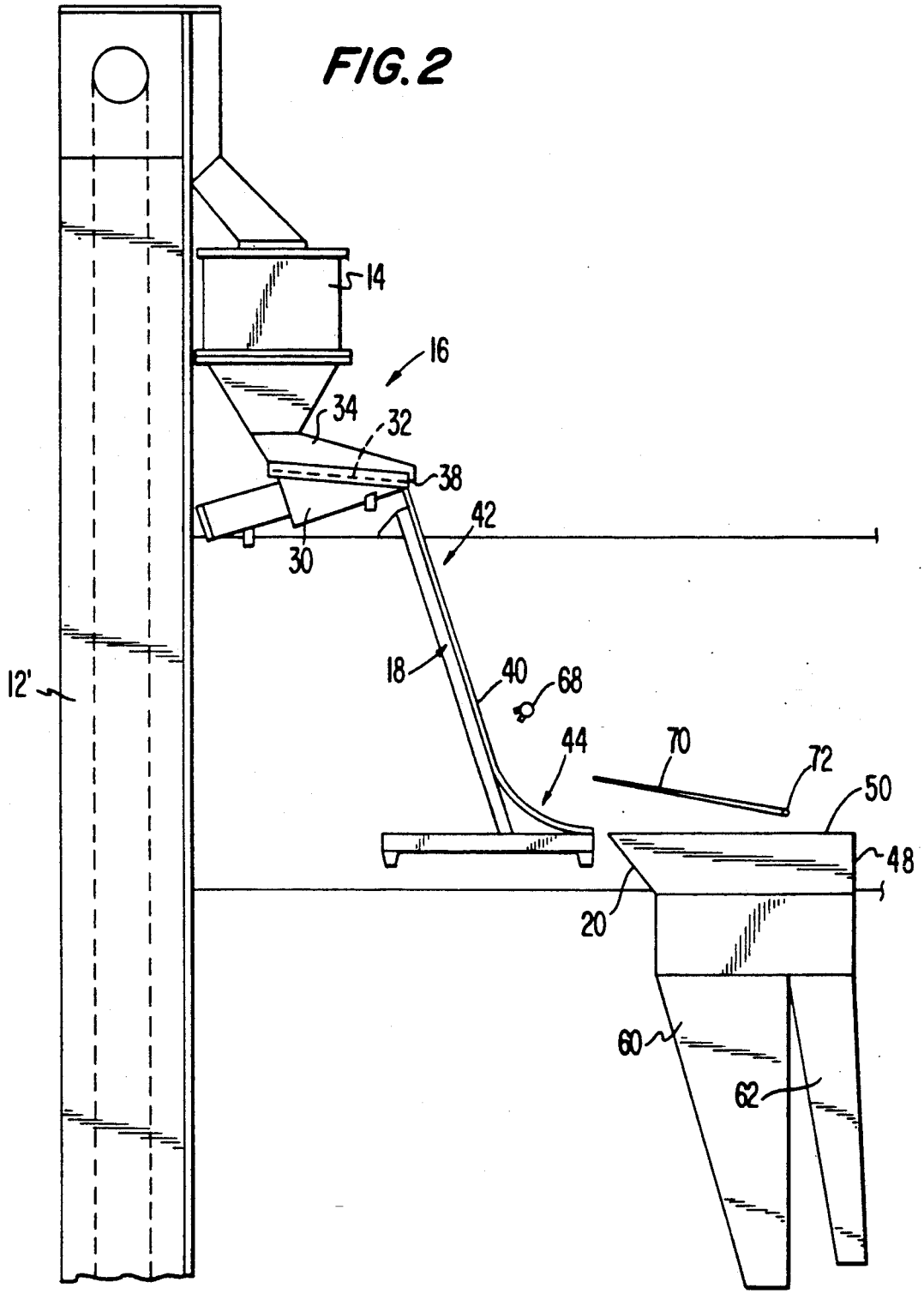
FIG. 2 is an enlarged elevational view of a typical stage of the separating system shown in FIG. 1.
Figure 3:
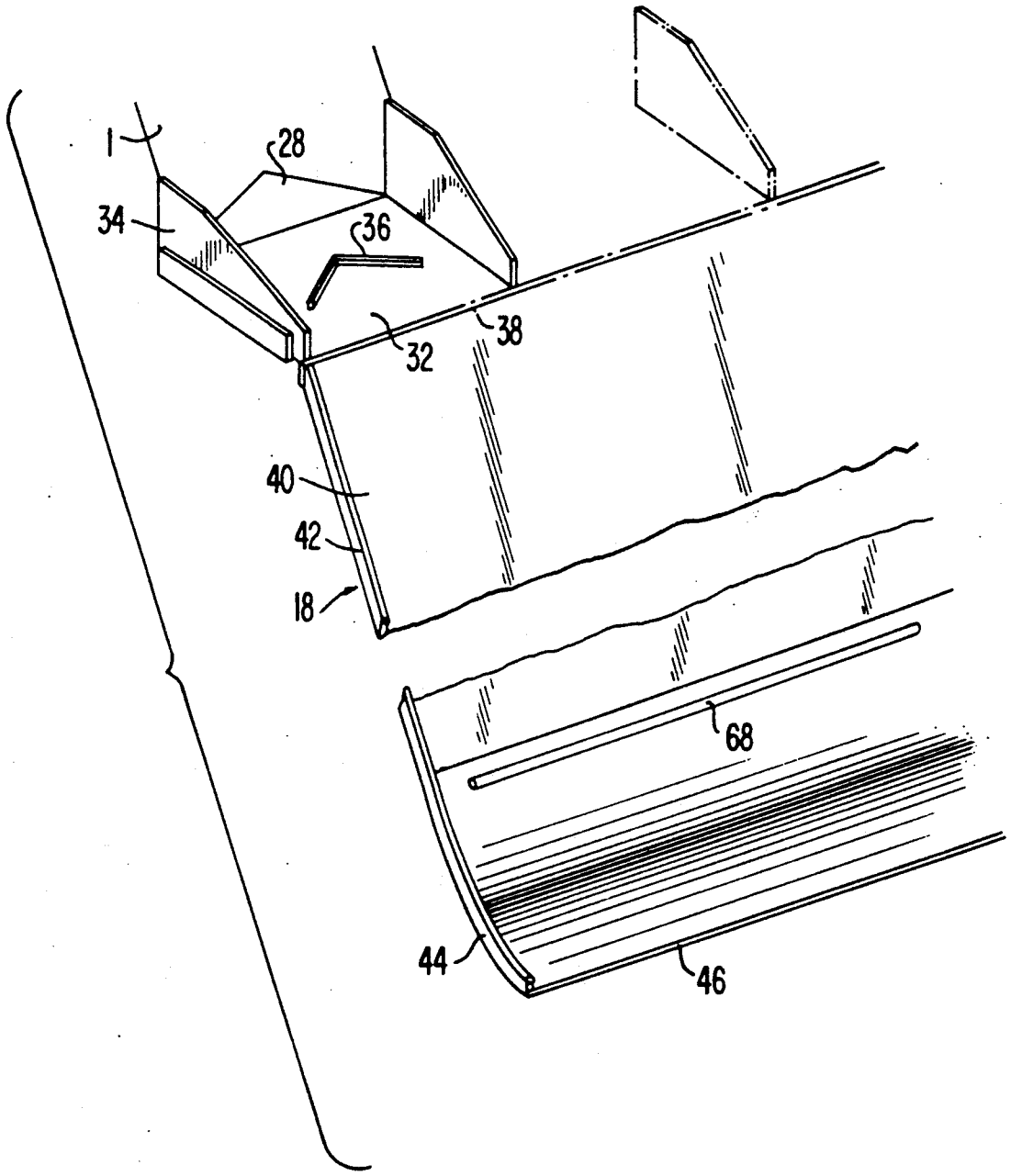
FIG. 3 is a partial isometric view of the separating apparatus and feed mechanism shown in FIG. 1.

Yet another expedient utilized in the practice of the invention is the use of deflector plates 70 for preventing the deposition o dolomite particles into the talc-receiving compartments 54 as a result of an increased trajectory imparted to some of these particles due to their being harder and thus having an increased tendency to bounce, as compared with talc particles. Thus, deflector plates 70 formed of an appropriate length, depending on the dimensional extent of the open upper end of the dolomite-receiving compartment 52 in the respective receptacle assemblies 20, are disposed over the discharge ends of the slide 18 and the compartments 52 in a location just slightly above the trajectory paths traversed by the talc particles in flowing from the ends 46 of slides 18 to the compartments 54. The deflector plates 70 thus serve to deflect any dolomite particles that bounce upon leaving the slide 18 and direct them into their appropriate compartments 52. As shown in FIGS. 1 and 2, the deflector plates 70 are preferably mounted for angular adjustment by means of pivoted mountings 72.

Figure 4:
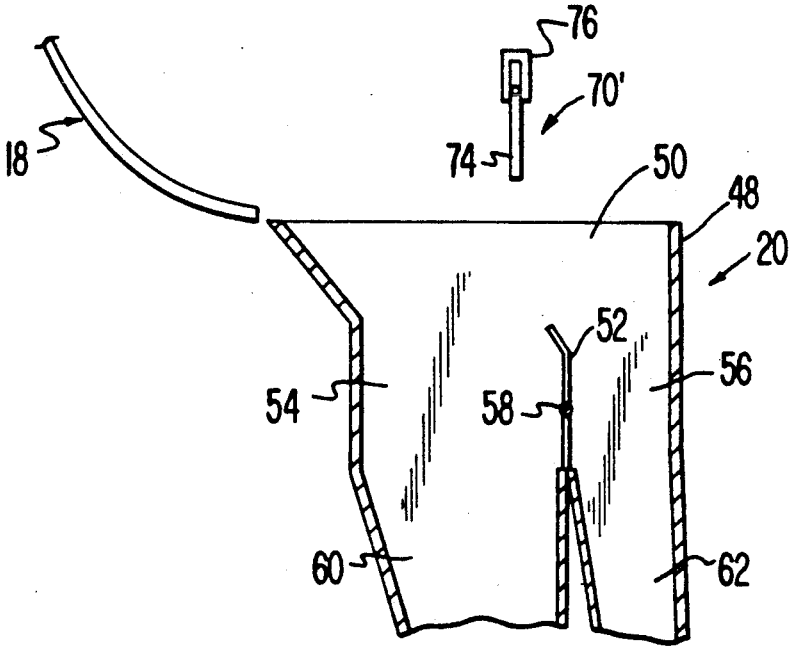
FIG. 4 is a sectional view of a typical receptacle employing an alternative form of deflector plate suitable for use in the present invention.

In FIG. 4 is shown a alternative deflector device 70' involving an essentially flat depending plate or curtain 74 that is pin-mounted for vertical adjustment in brackets 75. The depending plate or curtain is disposed such that its lower end is positioned above the trajectories of the talc particles passing from slides 18 to compartments 54, while the device is otherwise capable of preventing passage to the compartments 54 of any dolomite particles that may bounce upon leaving the end of the slide.

The operation of the particle separation system shown in FIG. 1 and organized to process commercially pure talc from a talc-dolomite "as mined" mixture at the rate of about 36 tons per hour employs separator slides 18, the length of the straight portions 52 of which are each about ten feet. The effective width of the sliding surfaces 40 of the slides 18 should be about twelve feet in stages A and B and about eight feet in stages C and D. As each vibratory feeder 30 is designed to effectively supply process material to about a four foot width of slide surface 40, three feeders are preferably employed in stages A and B and only two feeders in each of stages C and D. The surfaces 40 of the discharge portions 44 of the respective slides 18 are wetted with water from the water spray devices 68 sufficiently to only provide a light liquid coating on the surfaces. A liquid feed rate of about 0.05 gallons per minute per foot of slide width is found to be suitable for this purpose.

Process mixture containing particles of about two inch screen size is supplied to the feed bin 14 of stage A of the system via the conveyor belt 12. This material is fed by gravity through the bin opening 28 into the feed tray 32 of the vibratory feeder 30 wherein, in migrating toward the discharge lip 38, the particles are caused to be laterally distributed by barrier 36 substantially uniformly across the width of the tray to exit the lip 38 onto the surface 40 of the slide 18. As the slide surface 40 in the inclined straight portion 42 is dry, the mixture of talc and dolomite particles slide downwardly across the surface at a substantially constant acceleration and enter the discharge portion at a substantially uniform velocity of about 24 feet per second. Effective separation of the particles is achieved on the surface of the discharge portion 44 where, because the surface is wetted, a significant disparity in the relative velocities of the talc and dolomite particles is achieved due to the fact that, while wetting the slide surface 40 in this region of the slide has little or no effect on the coefficient of sliding friction between the surface and the dolomite particles, it effects a significant reduction in the coefficient between the surface and the talc-containing particles. Consequently, the dolomite particles, being imparted with a relatively lower velocity, are discharged from the end 46 of the slide 18 into the open upper end of the nearer compartment 54 of the receptacle assembly 20. Particles of dolomite that may tend to bounce from the end of the slide due to their characteristic resiliency are deflected via deflector plate 70 into the compartment 54 and are thus prevented from contaminating the predominantly talc fraction that is discharged, due to the relatively greater velocity assumed by the particles in passing from the end of the slide, into the compartment 56.

The waste or tailings fraction of the separated mixture is discharged through the open bottom end of the discharge hopper 60 onto the waste discharge conveyor 24 that, as shown in the drawing figure, may be common to stages A, B and C. The talc-laden fraction, on the other hand, is caused to pass through discharge hopper 62 into the lower end of the bucket conveyor 12' that conducts the particulate material upwardly from the hopper for discharge into the feed bin 14 of stage B from whence the previously described separation process is repeated. The described separation process is again repeated in stages C and D, except that the mixture fraction removed from the compartment 64 of the stage B receptacle assembly 20' can be discharged from the open bottom of the compartment onto the product discharge belt 22 positioned thereunder and conducted to storage or to a point of further processing.

As the tailings fraction separated in stage D of the system may yet contain an amount of talc particles, the system may, as shown, be provided with a recycle conveyor 26 for receiving tailings from the hopper 60 and returning it to a return hopper 78 for delivering the material to the stage C bucket conveyor 12' for reprocessing.

It should be understood that, although a preferred embodiment of the invention has been illustrated and described herein, changes and modifications can be made in the described arrangement without department from the scope of the appended claims.

We claim:

1. Apparatus for the separation of a mixture of discrete particulate materials of disparate composition comprising:

a downwardly inclined straight portion along which particles of said mixture materials are adapted to slide, said straight portion being inclined to an extent and having a surface related to said particles to exhibit a first coefficient of friction to cause said particles to achieve a substantially uniform velocity while undergoing gravitationally-induced sliding movement therealong;

a discharge portion tangentially disposed with respect to the terminal end of said inclined straight surface, said discharge portion having a concavely curved surface against which said particles are induced by centrifugal action and exhibiting a second coefficient of friction therewith to slide at disparate velocities due to differences in sliding coefficients of friction between said particles and said discharge portion surface to emerge therefrom at disparate velocities;

means for feeding a particulate mixture to the upper end of said inclined surface for separation; and means forming a receptacle assembly located adjacent the discharge end of said discharge portion, said receptacle assembly having separate compartments disposed in mutually spaced relation for receiving the respective particles on a basis of their discharge velocities from the surface of said discharge portion.

2. Apparatus according to claim 1 in which said straight surface is inclined at an angle from the vertical in the range of about 0 degrees to 20 degrees.

3. Apparatus according to claim 2 in which said straight surface is inclined at an angle from the vertical of about 18 degrees.

4. Apparatus according to claim 2 in which said straight surface and the surface of said discharge portion have different sliding coefficients of friction with respect to said mixture particles.

5. Apparatus according to claim 4 in which said straight surface has a sliding coefficient of friction with respect to said mixture particles that is higher than that of said discharge portion.

6. Apparatus according to claim 5 in which said straight surface and that of said discharge portion are formed of different materials.

7. Apparatus according to any one of claims 1 to 6 including means for discharging wetting liquid solely onto the slide surface of said discharge portion.

8. Apparatus according to any one of claims 1 to 6 including a deflector plate operably disposed with respect to the end of said discharge portion for intercepting particles of the mixture possessing a relatively lower velocity that are propelled vertically from the end of said discharge portion and for directing such particles into the appropriate receptacle compartment.

9. Apparatus according to claim 1 in which said receptacle compartments are mutually divided by a common partition plate, and means for moving said partition plate in order to adjust the split of mixture materials received in the respective compartments.

10. Apparatus according to any one of claims 1 to 6 in which said mixture feeding means includes means for spreading said particulate materials substantially uniformly across the width of said straight surface.

11. Apparatus according to claim 10 in which said mixture feeding means is a vibratory feeder.

12. A system for the separation of a mixture of discrete particulate materials of disparate composition including a plurality of material separation stages arranged for series flow of material and each said stage including apparatus comprising:

a downwardly inclined straight portion along which particles of said mixture materials are adapted to slide, said straight portion being inclined to an extent and having a surface related to said particles to exhibit a first coefficient of friction to cause said particles to achieve a substantially uniform velocity while undergoing gravitationally-induced sliding movement therealong;

a discharge portion tangentially disposed with respect to the terminal end of said inclined straight surface, said discharge portion having a concavely curved surface against which said particles are induced by centrifugal action and exhibiting a second coefficient of friction therewith to slide at disparate velocities due to differences in sliding coefficients of friction between said particles and said surface of said discharge portion to emerge therefrom at disparate velocities;

means for feeding a particulate mixture to the upper end of said inclined surface for separation; and means forming a receptacle assembly located adjacent the discharge end of said discharge portion, said receptacle assembly having compartments disposed in mutually spaced relation for receiving the respective particles on a basis of their discharge velocities from said discharge portion.

13. The system according to claim 12 in which said apparatus includes a straight surface inclined at an angle from the vertical in the range of about 0 degrees to 20 degrees.

14. The system according to claim 13 in which said straight surface is inclined at an angle from the vertical of about 18 degrees.

15. The apparatus according to claim 13 in which the slide surface of said straight portion of that of said discharge portion have different sliding coefficients of friction with respect to said mixture particles.

16. The system according to claim 15 in which said straight surface has a sliding coefficient of friction with respect to said mixture particles that is higher than that of said discharge portion.

17. The system according to claim 16 in which said straight surface and that of said discharge portion are formed of different materials.

18. The system according to any one of claims 12 to 17 in which said apparatus includes means for discharging wetting liquid solely onto the slide surface of said discharge portion.

19. The system according to any one of claims 12 to 17 in which said apparatus includes a deflector plate operably disposed with respect to the end of said discharge portion for intercepting particles of said mixture possessing a relatively lower velocity that are propelled vertically from the end of said discharge portion and for directing such particles into the appropriate compartment.

20. The system according to claim 12 in which said receptacle compartments are mutually divided by a common partition plate, and means for moving said partition plate in order to adjust the split of mixture materials received in the respective compartments.

21. The system according to any one of claims 12 to 17 in which said mixture feeding means to said apparatus includes means for spreading said particulate materials substantially uniformly across the width of the slide surface of said separator.

22. The system according to claim 21 in which said mixture feeding means is a vibratory feeder.

23. The system according to claim 12 including means for recycling a fraction of material discharged into a selected one of said receptacle compartments in the final separation stage to the feed means associated with an intermediate separation stage.

24. The system according to claim 12 in which said receptacle compartments include means for receiving a waste fraction, a blend fraction and a product fraction.

25. The system according to claim 24 including means for supplying said blend fraction to the feed means associated with the succeeding separation stage.

26. A method of separating a mixture of discrete particulate materials of disparate composition on an integral inclined slide structure comprising the steps of:

causing said particles to slide by gravity along a first slide surface exhibiting substantially the same coefficient of sliding friction between the respective mixture particles until a substantially uniform particle velocity is achieved;

passing said particles to a second slide surface exhibiting appreciably different coefficients of sliding friction between the respective mixture particles and inducing sliding movement of said particles therealong, whereby said particles of the respective mixture fractions move at appreciably different velocities, and collecting said particles on the basis of their respective velocities.

27. The method according to claim 26 wherein said sliding movement of said particles along said second slide surface is induced by centrifugally impelling said particles against said second surface.

28. The method according to claim 27 wherein said different coefficients of sliding friction between the particles of the respective mixture fractions is achieved by forming said second slide surface of a different material than that of said first slide surface.

29. The method according to any one of claims 26, 27 or 28 including the step of wetting the latter mentioned slide surface while keeping the former dry.

* * * * *